US008215635B2

(12) United States Patent
Wada et al.

(10) Patent No.: US 8,215,635 B2
(45) Date of Patent: Jul. 10, 2012

(54) MANUAL SHEET FEEDER AND IMAGE FORMING APPARATUS PROVIDED WITH THE SAME

(75) Inventors: Hiroshi Wada, Osaka (JP); Toshio Hori, Osaka (JP); Yoshiaki Tashiro, Osaka (JP); Hironori Daigo, Osaka (JP); Seiji Okada, Osaka (JP); Yuichiro Tanaka, Osaka (JP); Nobuhiro Nishioka, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 13/045,634

(22) Filed: Mar. 11, 2011

(65) Prior Publication Data

US 2011/0227277 A1 Sep. 22, 2011

(30) Foreign Application Priority Data

Mar. 18, 2010 (JP) ..... 2010-062496

(51) Int. Cl.
*B65H 1/12* (2006.01)
*B65H 1/08* (2006.01)

(52) U.S. Cl. ..... 271/160; 271/128

(58) Field of Classification Search ..... 271/145, 271/160, 162, 117, 118, 126, 127, 22, 24, 271/128–130
See application file for complete search history.

(56) References Cited

U.S. PATENT DOCUMENTS

| | | | | |
|---|---|---|---|---|
| 4,765,605 | A * | 8/1988 | Abbott | 271/147 |
| 5,909,872 | A * | 6/1999 | Takahashi | 271/116 |
| 5,954,327 | A * | 9/1999 | Lin et al. | 271/110 |
| 6,042,103 | A * | 3/2000 | Yraceburu et al. | 271/118 |
| 2001/0028141 | A1 * | 10/2001 | Kotaka et al. | 271/10.11 |

FOREIGN PATENT DOCUMENTS

| | | | |
|---|---|---|---|
| JP | 58100348 | | 8/1983 |
| JP | 61291325 | A * | 12/1986 |
| JP | 2008-179440 | | 8/2008 |
| JP | 2009-91143 | | 4/2009 |

* cited by examiner

*Primary Examiner* — Kaitlin Joerger
*Assistant Examiner* — Patrick Cicchino
(74) *Attorney, Agent, or Firm* — Gerald E. Hespos; Michael J. Porco

(57) ABSTRACT

A sheet feeder has a tray on which a sheet to be fed is to be placed. A lift plate is at a feeding end of the tray and has a first end at an upstream side in a feeding direction connected rotatably to the tray. The lift plate is displaceable between a feeding posture where a second end at a downstream side in the feeding direction is lifted up and a retracted posture where the second end is lower than in the feeding posture due to its own weight. A biasing member gives a biasing force to an elevating member in a direction to lift the lift plate to the feeding posture. A lowering mechanism gives a pressing force against the force of the biasing member to lower the lift plate to the retracted posture.

10 Claims, 14 Drawing Sheets

MANUAL SHEET FEEDER AND IMAGE FORMING APPARATUS PROVIDED WITH THE SAME

BACKGROUND OF THE INVENTION

1. Field of the Invention

The present invention relates to a sheet feeder on which a user can manually place a sheet and an image forming apparatus provided with such a sheet feeder.

2. Description of the Related Art

An image forming apparatus such as a printer includes, in many cases, a sheet feed path for automatically feeding a sheet from a sheet cassette mounted in an apparatus main body and a sheet feed path for feeding a sheet manually placed on a manual feed tray by a user. Usually, widely used A4 size sheets are fed from the sheet cassette and sheets of a variety of sizes such as a postcard size and an A3 size are fed from the manual feed tray. Usually, the manual feed tray is mounted to be openable and closable with respect to a housing of the apparatus main body, normally in a closed state and set to an opened state at the time of use.

A lift plate for bringing a manually placed sheet to a feed roller is attached to the manual feed tray. This lift plate is moved upward and downward by being lifted up to bring a sheet to the feed roller when the sheet is fed while being released from its lifted position and lowered when no sheet is fed. Such upward and downward movements are performed by a push-up cam arranged on the rear surface of a lift plate in a conventional sheet feeder (prior art apparatus 1). This push-up cam is driven by a driving system including a motor and a drive gear. Besides this, there is also known a sheet feeder (prior art apparatus 2) constructed such that a spring is arranged on the rear surface of a lift plate to constantly bias the lift plate in a direction toward a feed roller.

An unexpected force may act on the lift plate of the manual feed tray. For example, a user may press the manual feed tray with a large force after placing a bundle of sheets on the manual feed tray. In this case, in the prior art apparatus 1, the driving system may be damaged by an external force if the lift plate is in a state lifted up by a mechanism such as the push-up cam.

On the other hand, in the sheet feeder including the spring like the prior art apparatus 2, there is no problem of damage since the lift plate easily escapes if an external force as described above acts. However, in a sheet feeder dependent only on a spring load, it is difficult to give a sheet feed pressure corresponding to the thickness of the bundle of sheets to a feed roller and accuracy of spring loading needs to be increased. In addition, it is necessary to add a mechanism for preventing the lift plate from being inclined when a bundle of sheets is set on the manual feed tray. These requirements lead to a cost increase of the sheet feeder.

SUMMARY OF THE INVENTION

An object of the present invention is to provide a sheet feeder having a stable sheet feeding performance despite its simple construction and prepared for an external force and an image forming apparatus employing such a sheet feeder.

In order to accomplish this object, one aspect of the present invention is directed to a sheet feeder, including a tray main body on which a sheet to be fed is to be placed; a lift plate which is a plate body arranged at a feeding end side of the tray main body, rotatably connected to the tray main body at a first end edge portion at an upstream side in a feeding direction and displaceable between a feeding posture where a second end edge portion at a downstream side in the feeding direction is lifted up and a retracted posture where the second end edge portion is located lower than in the feeding posture due to its own weight; an elevating member including a part which comes into contact with the lift plate; a biasing member for giving a biasing force to the elevating member in such a direction that the elevating member lifts the lift plate to the feeding posture; and a lowering mechanism for giving a pressing force, which acts against the biasing force of the biasing member, to a part of the elevating member to lower the lift plate to the retracted posture.

Another aspect of the present invention is directed to an image forming apparatus, including an image forming station for performing an image forming process on a sheet; a housing for housing the image forming station; and a sheet feeder mounted in the housing for supplying a sheet to the image forming station, wherein the sheet feeder has the above construction.

These and other objects, features and advantages of the present invention will become more apparent upon reading the following detailed description along with the accompanying drawings.

DETAILED DESCRIPTION OF THE PREFERRED EMBODIMENTS

Figure 1:
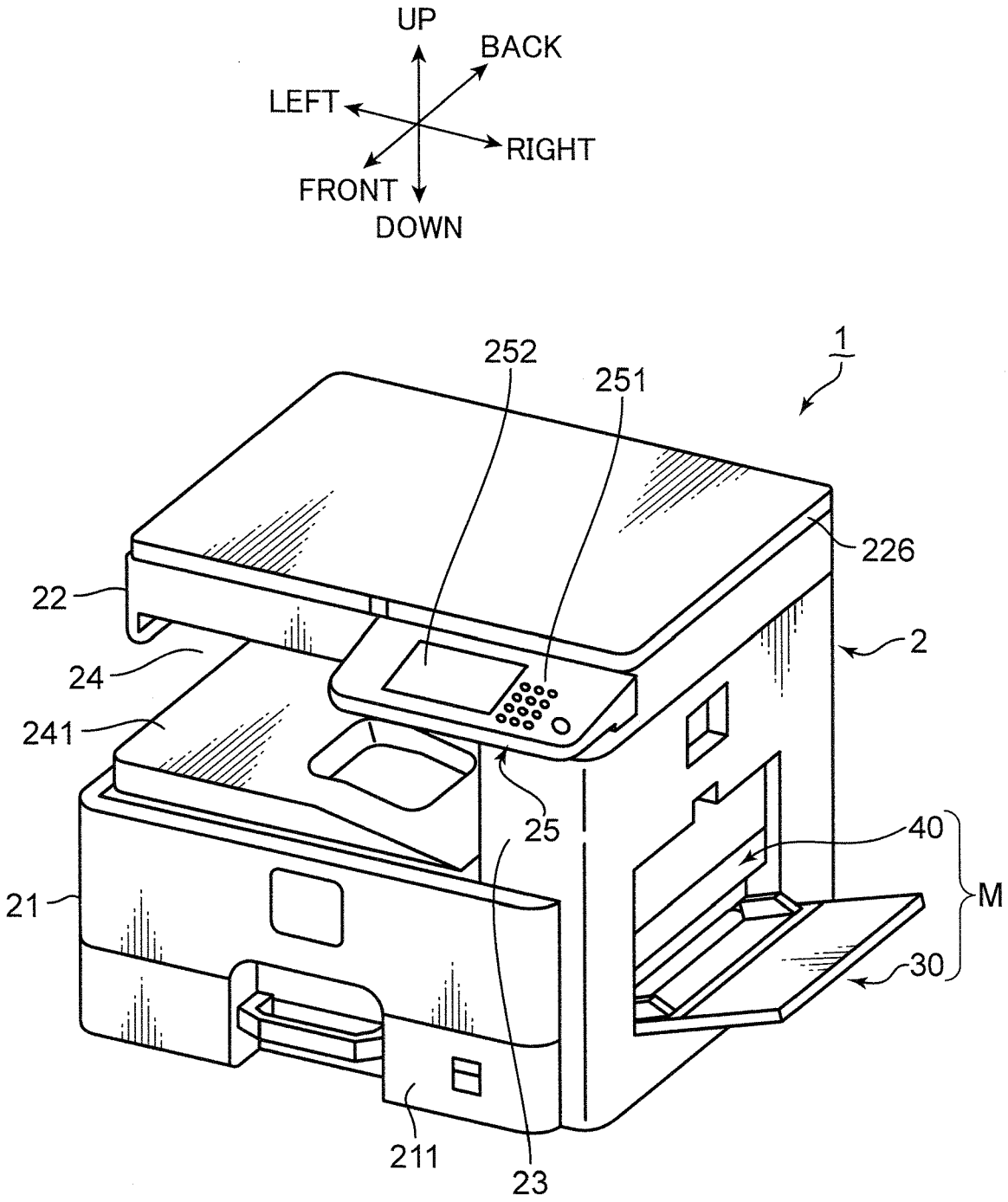
FIG. 1 is a perspective view showing an external appearance of an image forming apparatus according to one embodiment of the invention.
Figure 2:
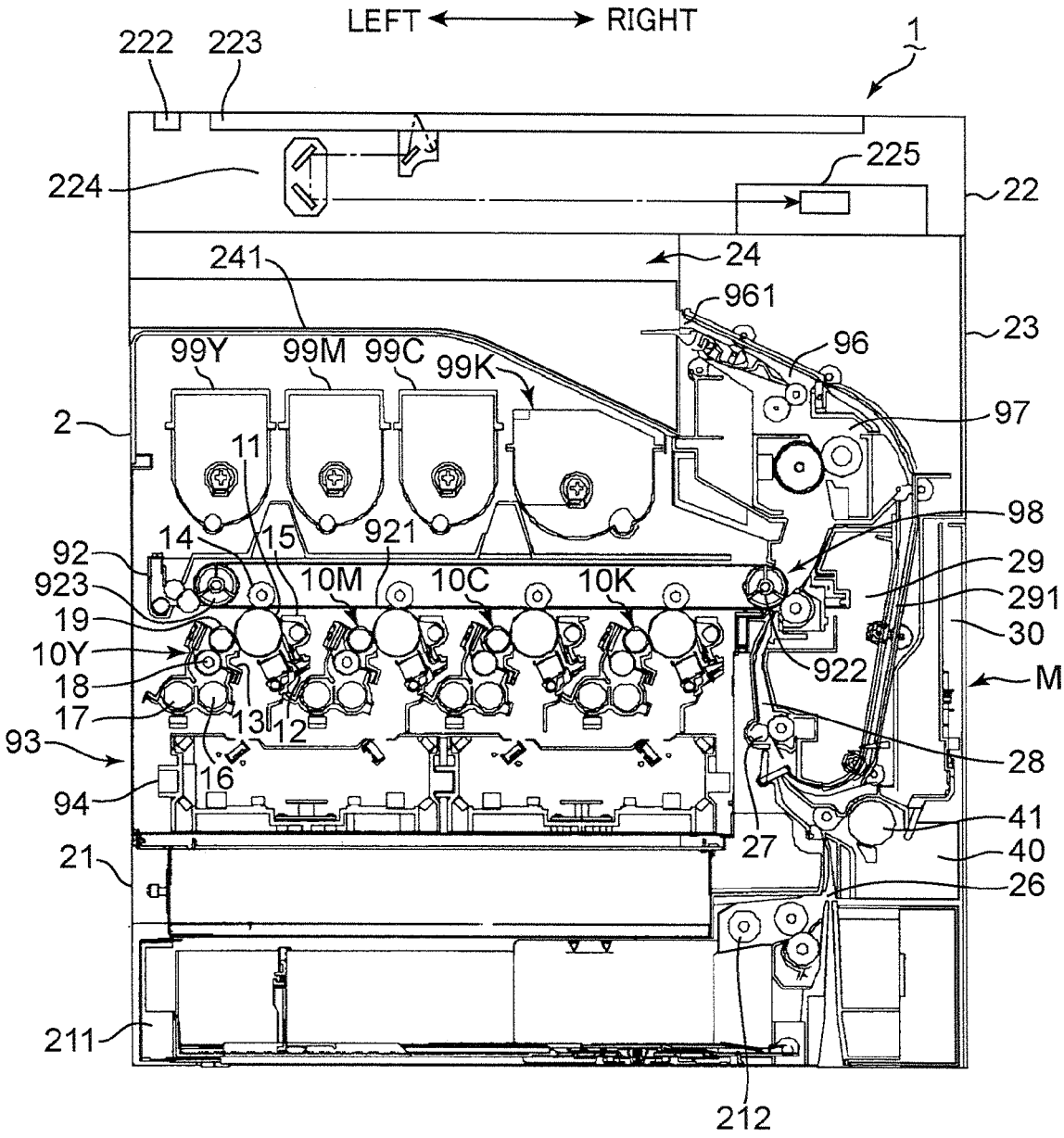
FIG. 2 is a sectional view showing an internal structure of the image forming apparatus.

Hereinafter, one embodiment of the present invention is described in detail with reference to the drawings. FIG. 1 is a perspective view showing an external appearance of an image forming apparatus 1 according to one embodiment of the invention, and FIG. 2 is a sectional view showing an internal structure of the image forming apparatus 1. Here, the image forming apparatus 1 is a copier of a so-called internal discharge type, but the image forming apparatus may be a printer, a facsimile machine, or a complex machine provided with these functions.

The image forming apparatus 1 includes an apparatus main body 2 having a substantially rectangular parallelepipedic housing structure and an internal space (internal discharge space 24). The apparatus main body 2 performs an image forming process on a sheet. The apparatus main body 2 includes a substantially rectangular parallelepipedic lower housing 21, a substantially rectangular parallelepipedic upper housing 22 arranged above the lower housing 21, and a coupling housing 23 coupling the lower housing 21 and the upper housing 22. Various devices for image formation are housed in the lower housing 21, and various devices for optically reading a document image are housed in the upper housing 22. An internal space enclosed by the lower housing 21, the upper housing 22 and the coupling housing 23 serves as an internal discharge portion 24 capable of storing a sheet after image formation. The coupling housing 23 is arranged at a side of the right surface of the apparatus main body 2 and provided with a discharge opening 961 for discharging a sheet to the internal discharge portion 24.

The internal space utilized as the internal discharge portion 24 is exposed to the outside at the front surface and the left surface of the apparatus main body 2. A user can take a sheet after image formation out from the internal discharge portion 24 by inserting his or her hand through these exposed parts. A bottom surface 241 of the internal space is defined by the upper surface of the lower housing 21, and sheets discharged from the discharge opening 961 are stacked thereon.

An operation panel unit 25 is provided to project from the front surface of the upper housing 22. The operation panel unit 25 is provided with operation keys 251 including a numerical pad and a start key, an LCD touch panel 252, etc. and receives input of various operation instructions from the user. The user can input the number of sheets to be printed, print density, etc. by means of the operation panel unit 25. A pressing cover 226 (not shown in FIG. 2) for pressing a document whose image is to be read is arranged on the upper housing 22. The pressing cover 226 is rotatably mounted on the upper housing 22 at a rear end edge thereof.

A sheet cassette 211 for storing sheets, to which an image forming process is to be applied, is mounted in the lower housing 21. The sheet cassette 211 can be withdrawn forward from the front surface of the lower housing 21 (apparatus main body 2). This sheet cassette 211 is the one for automatic sheet feeding.

A multi-tray unit M (sheet feeder) enabling a user to manually feed a sheet is mounted on the right surface of the apparatus main body 2. The multi-tray unit M includes a feed tray 30, on which a sheet is to be manually placed, and a feeding unit 40 for feeding the manually placed sheet to an image forming station in the lower housing 21. The feed tray 30 is openably and closably mounted on the lower housing 21 at a base end portion thereof and is in a closed state when not used. The user opens the feed tray 30 and places a sheet thereon in the case of manually feeding the sheet. This multi-tray unit M is described in detail later with reference to FIGS. 3 to 12.

Next, the internal structure of the apparatus main body 2 is described with reference to FIG. 2. Toner containers 99Y, 99M, 99C and 99K, an intermediate transfer unit 92, an image forming station 93, an exposure unit 94 and the above sheet cassette 211 are housed in this order from top in the lower housing 21.

The image forming station 93 includes four image forming units 10Y, 10M, 10C and 10K for forming toner images of yellow (Y), magenta (M), cyan (C) and black (K) to form a full-color toner image. Each of the image forming units 10Y, 10M, 10C and 10K includes a photoconductive drum 11, and a charger 12, a developing device 13, a primary transfer roller 14 and a cleaner 15 arranged around the photoconductive drum 11.

The photoconductive drum 11 rotates about its shaft and has an electrostatic latent image and a toner image formed on its circumference surface. A photoconductive drum using an amorphous silicon (a-Si) containing material can be used as the photoconductive drum 11. The charger 12 uniformly charges the circumferential surface of the photoconductive drum 11. The circumferential surface of the photoconductive drum 11 after charging is exposed by the exposure unit 94 to form an electrostatic latent image.

The developing device 13 supplies toner to the circumferential surface of the photoconductive drum 11 to develop the electrostatic latent image formed on the photoconductive drum 11. The developing device 13 is for a two-component developer and includes agitating rollers 16, 17, a magnetic roller 18 and a developing roller 19. The agitating rollers 16, 17 charge the toner by conveying the two-component developer in a circulating manner while agitating it. The two-component developer is carried on the circumferential surface of the magnetic roller 18, and the toner is transferred to the circumferential surface of the developing roller 19 due to a potential difference between the magnetic roller 18 and the developing roller 19, whereby a toner layer is formed on the circumferential surface of the developing roller 19. The toner on the developing roller 19 is supplied to the circumferential surface of the photoconductive drum 11, thereby developing the electrostatic latent image.

The primary transfer roller 14 forms a nip portion together with the photoconductive drum 11 for sandwiching an intermediate transfer belt 921 of the intermediate transfer unit 92, and primarily transfers the toner image on the photoconductive drum 11 to the intermediate transfer belt 921. The cleaner 15 cleans the circumferential surface of the photoconductive drum 11 after the transfer of the toner image.

The yellow toner container 99Y, the magenta toner container 99M, the cyan toner container 99C and the black toner container 99K are respectively for storing toners of the respective colors, and supply the toners of the respective colors to the developing devices 13 of the image forming units 10Y, 10M, 10C and 10K of the corresponding YMCK colors via unillustrated supply paths.

The exposure unit 94 includes a light source and various optical components such as a polygon mirror, a reflecting mirror and a deflecting mirror, and irradiates the circumferential surfaces of the photoconductive drums 11 provided in the respective image forming units 10Y, 10M, 10C and 10K with beams based on image data of a document image to form electrostatic latent images.

The intermediate transfer unit 92 includes the intermediate transfer belt 921, a drive roller 922 and a driven roller 923. Toner images from a plurality of photoconductive drums 11 are superimposed on the intermediate transfer belt 921 (primary transfer). The superimposed toner images are secondarily transferred to a sheet supplied from the sheet cassette 211 or the feed tray 30 in a secondary transfer unit 98. The drive roller 922 and the driven roller 923 for rotating the intermediate transfer belt 921 are rotatably supported on the lower housing 21.

The sheet cassette 211 stores a bundle of sheets stacked one over another. A pickup roller 212 is arranged above the right end of the sheet cassette 211. By driving the pickup roller 212, the uppermost sheet of the sheet bundle in the sheet cassette 211 is pickup up one by one and conveyed to a carry-in conveyance path 26. On the other hand, a sheet placed on the feed tray 30 is conveyed to the carry-in conveyance path 26 by driving a feed roller 41 (and an unillustrated pickup roller) of the feeding unit 40.

A sheet conveyance path 28 extending up to the discharge opening 961 via the secondary transfer unit 98, a fixing unit 97 and a discharge unit 96 to be described later is provided downstream of the carry-in conveyance path 26. An upstream part of the sheet conveyance path 28 is formed between an inner wall formed in the lower housing 21 and an inner wall forming the inner surface of a reversing unit 29. Note that an outer side surface of the reversing unit 29 constitutes one surface of a reversing conveyance path 291 for reversing and conveying a sheet at the time of duplex printing. A pair of registration rollers 27 is arranged at a position of the sheet conveyance path 28 upstream of the secondary transfer unit 98. The sheet is temporarily stopped by the pair of registration rollers 27 and fed to the secondary transfer unit 98 at a predetermined timing for image transfer after a skew correction.

The fixing unit 97 and the discharge unit 96 are housed in the coupling housing 23. The fixing unit 97 includes a fixing roller and a pressure roller and performs a fixing process by heating and pressing a sheet having a toner image secondarily transferred in the secondary transfer unit 98. The sheet with the fixed color image is discharged from the discharge opening 961 toward the internal discharge portion 24 by the discharge unit 96 arranged downstream of the fixing unit 97.

A first contact glass 222 and a second contact glass 223 are fitted in the upper surface of the upper housing 22. The first contact glass 222 is provided for reading a document sheet automatically fed by an automatic document feeder (ADF; not shown) when the ADF is arranged on the upper housing 22. The second contact glass 223 is provided for reading a manually placed document sheet.

A scanning mechanism 224 and an image pickup device 225 for optically reading document information are housed in the upper housing 22. The scanning mechanism 224 includes a light source, a moving carriage, a reflecting mirror, etc. and introduces reflected light from a document to the image pickup device 225. The image pickup device 225 photoelectrically converts the reflected light into an analog electrical signal, which is input to the exposure unit 94 after being converted into a digital electrical signal in an A/D conversion circuit (not shown).

Figure 3:
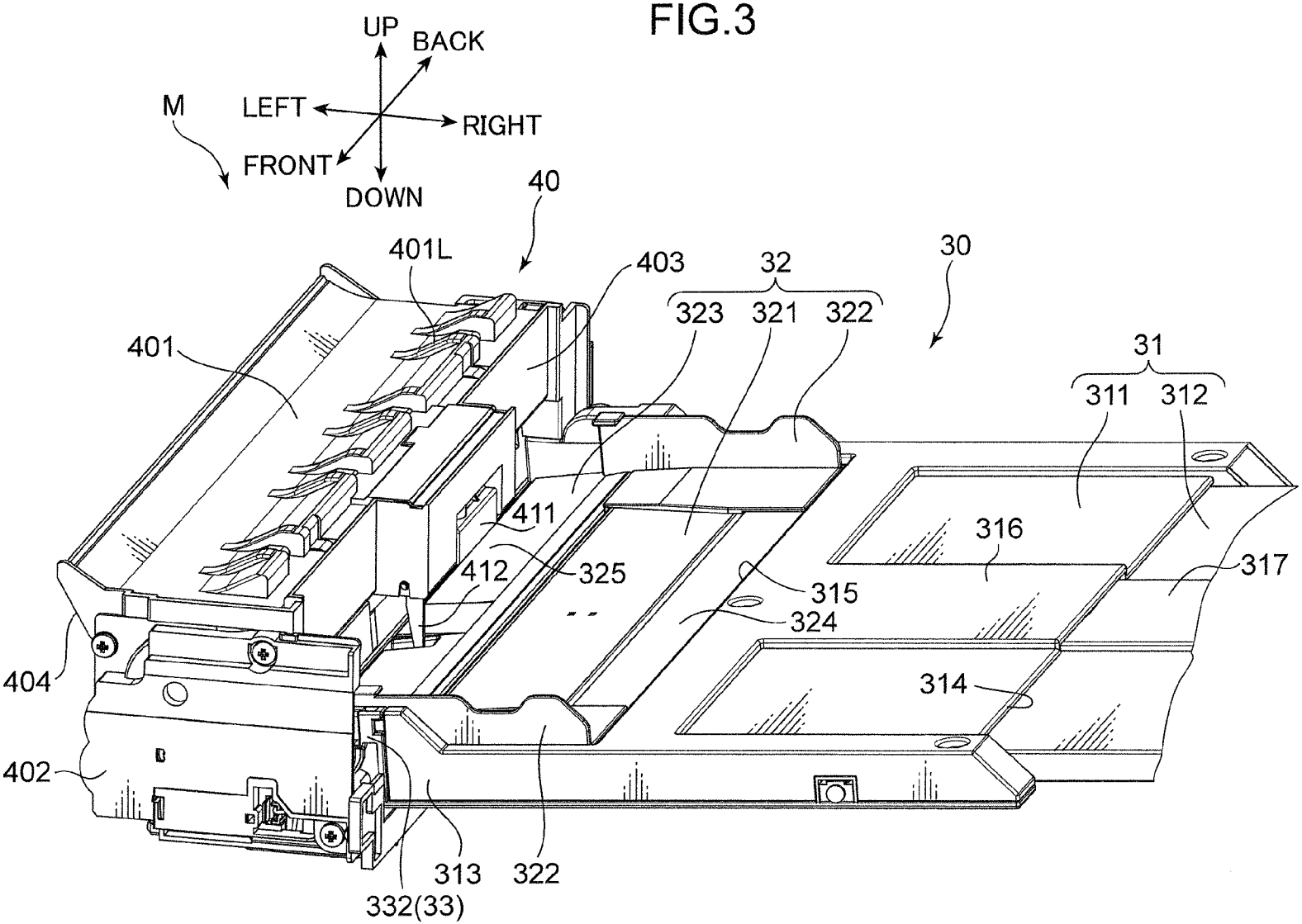
FIG. 3 is a perspective view of a multi-tray unit.
Figure 4:
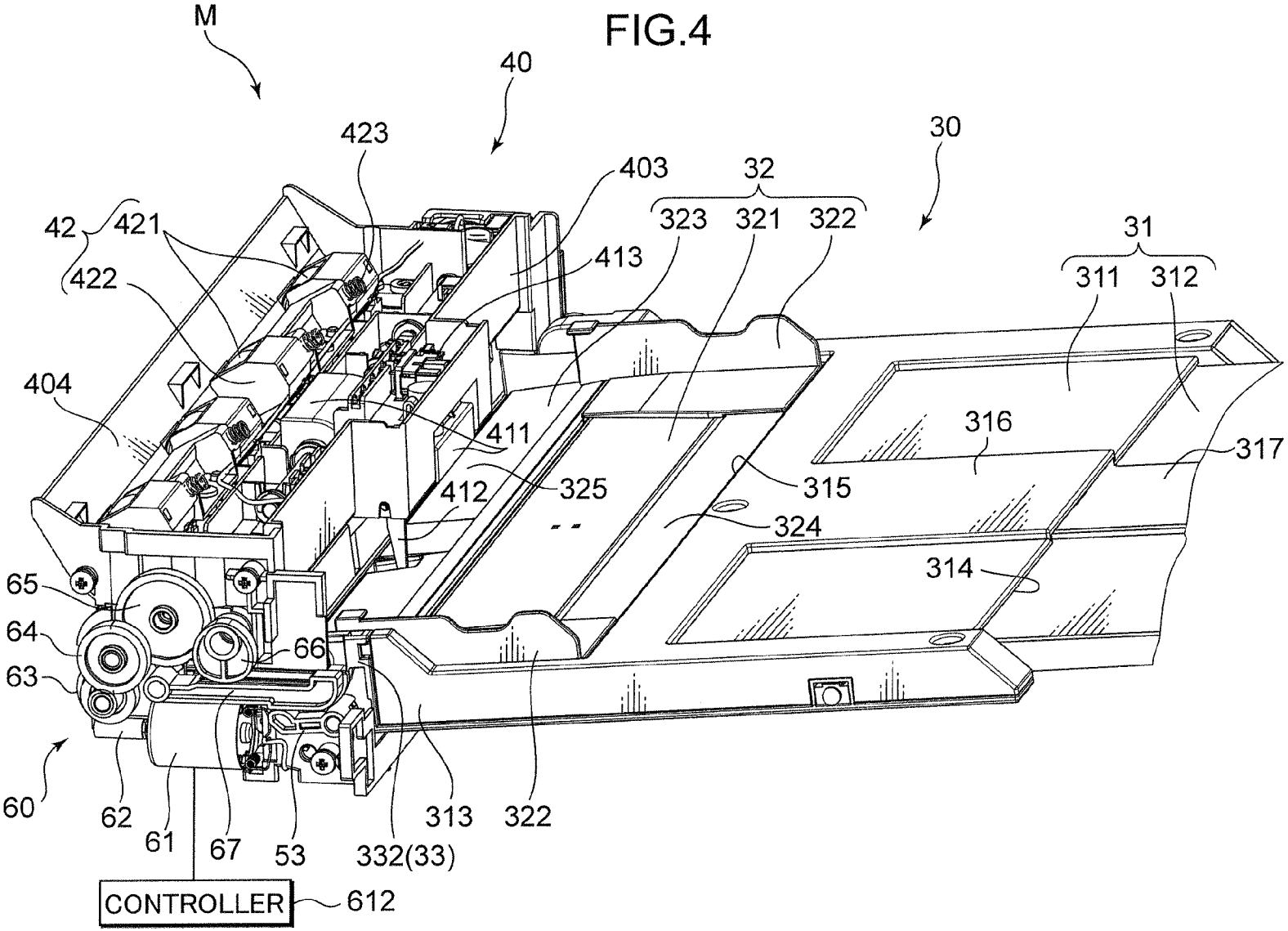
FIG. 4 is a perspective view of the multi-tray unit with an upper cover and a front cover detached.
Figure 5:
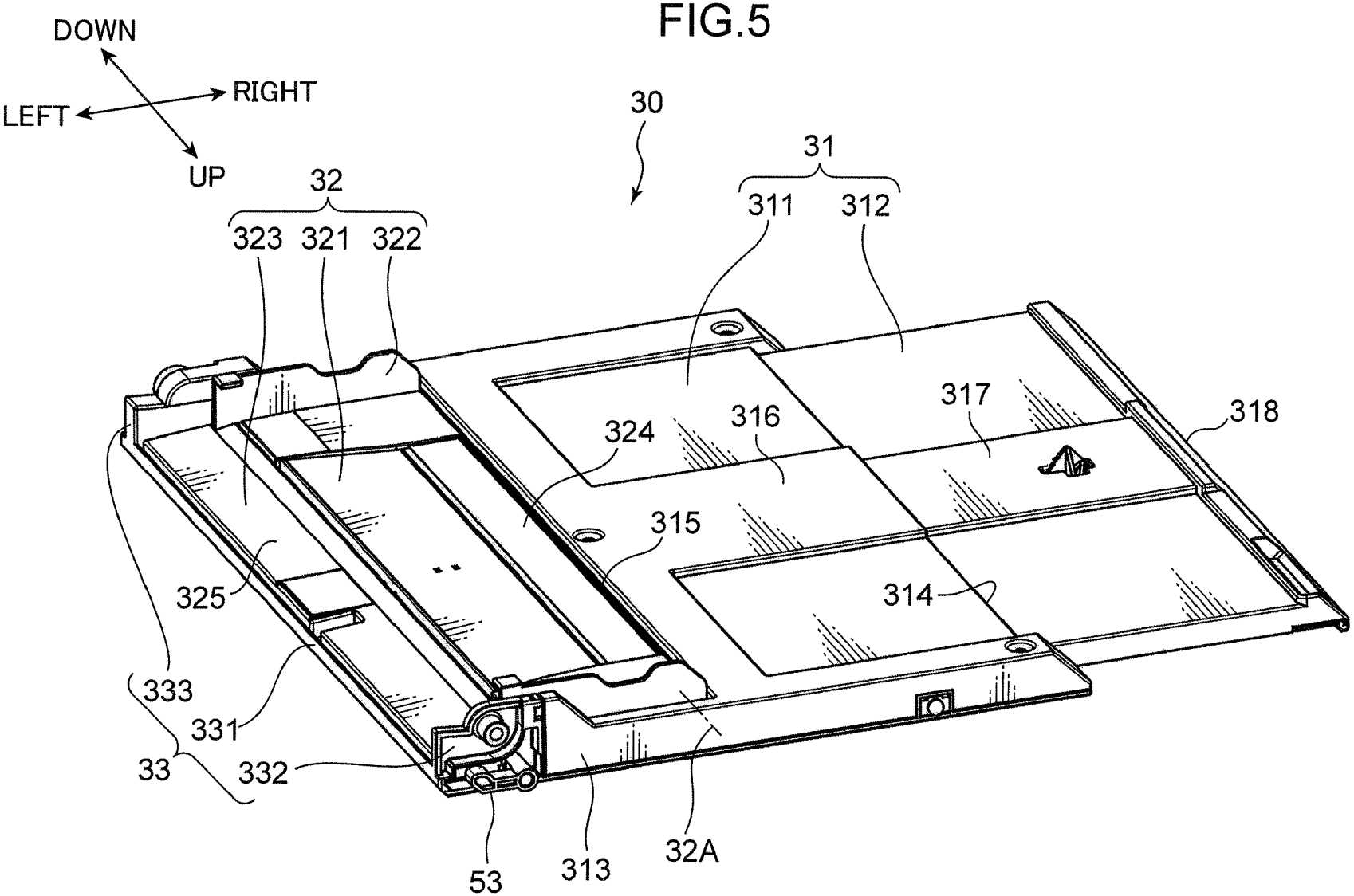
FIG. 5 is a perspective view of a feed tray in a lowered state of a lift plate.
Figure 6:
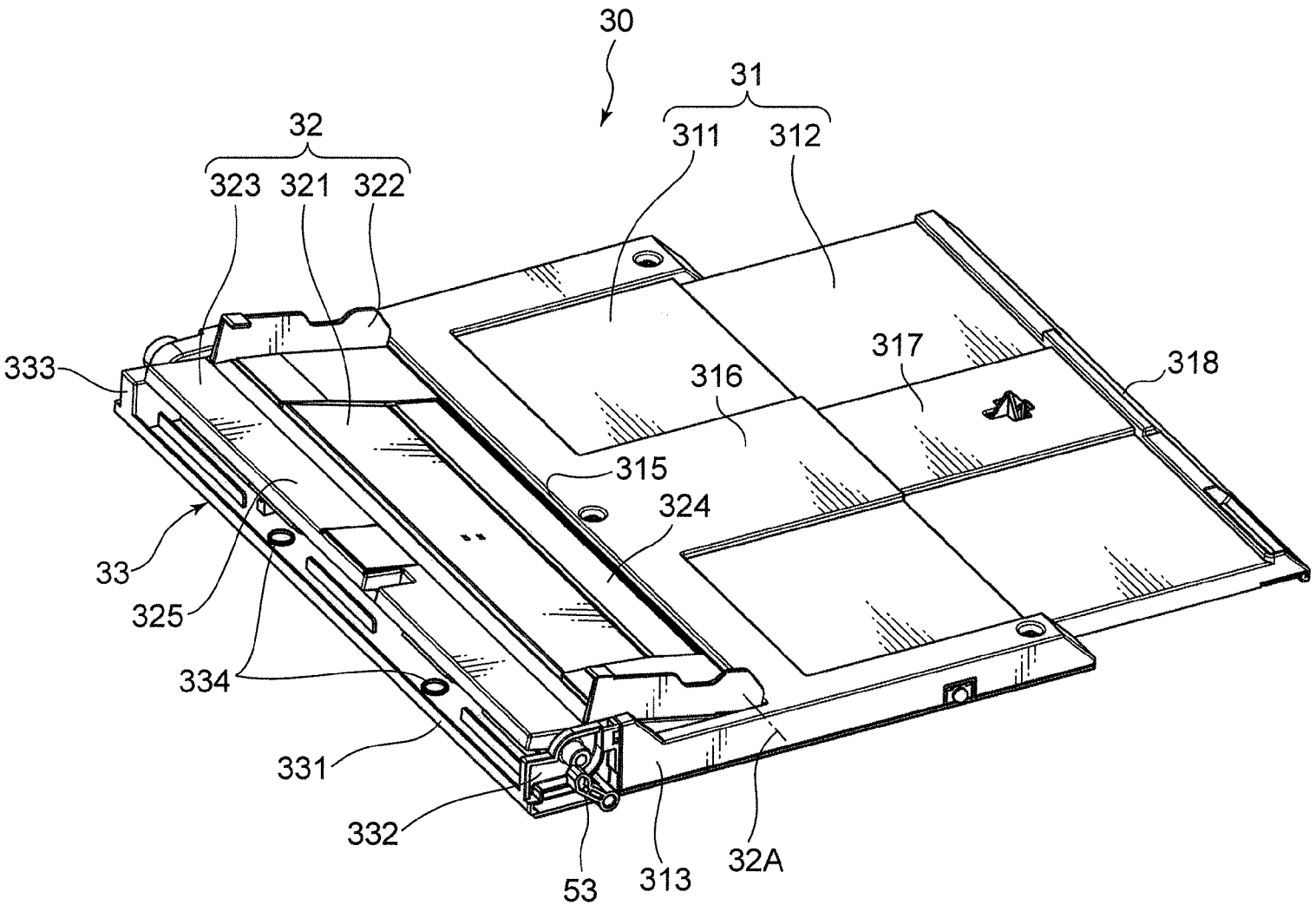
FIG. 6 is a perspective view of the feed tray in a lifted state of the lift plate.
Figure 7:
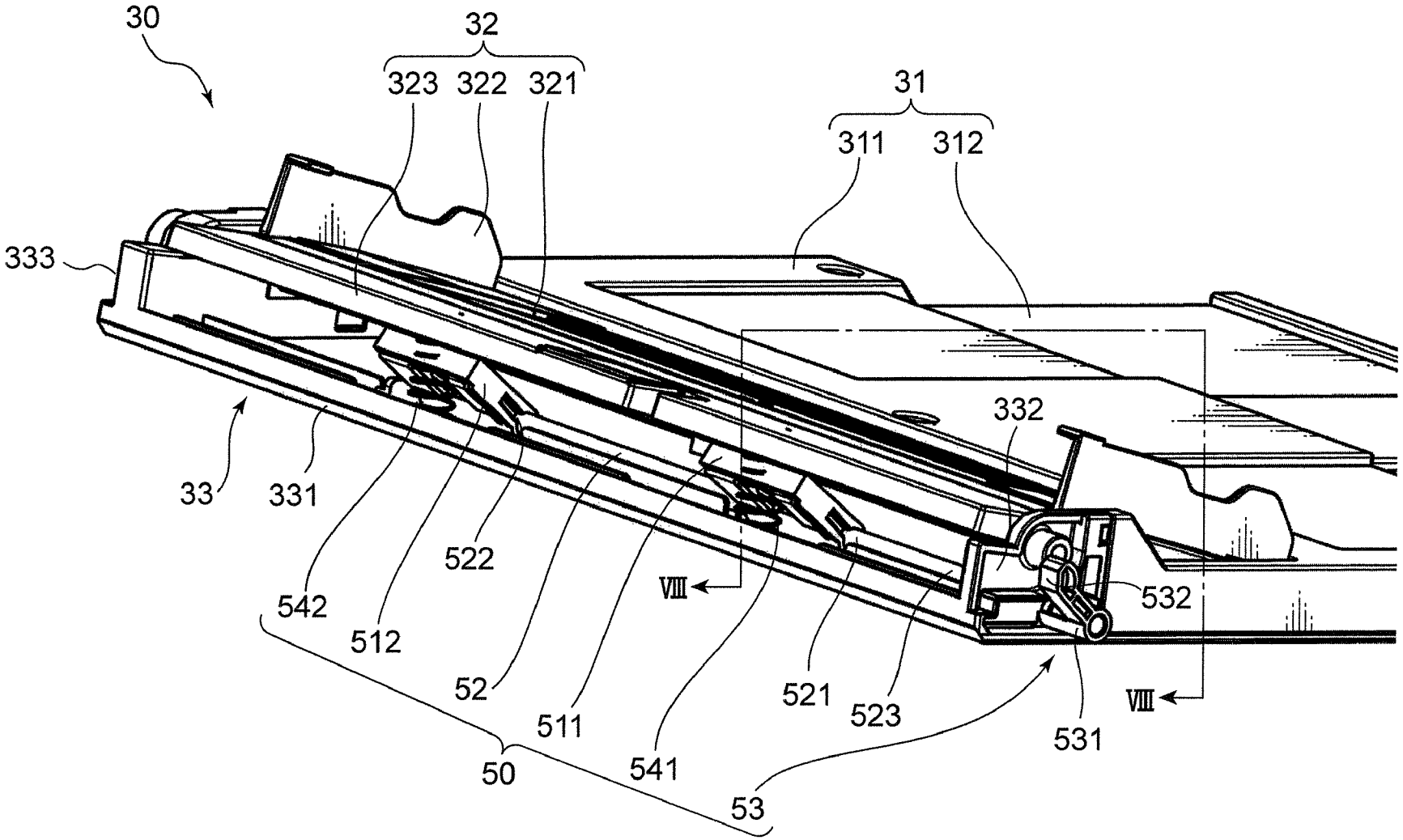
FIG. 7 is a perspective view showing a lifting mechanism (elevating member and biasing member).
Figure 8:
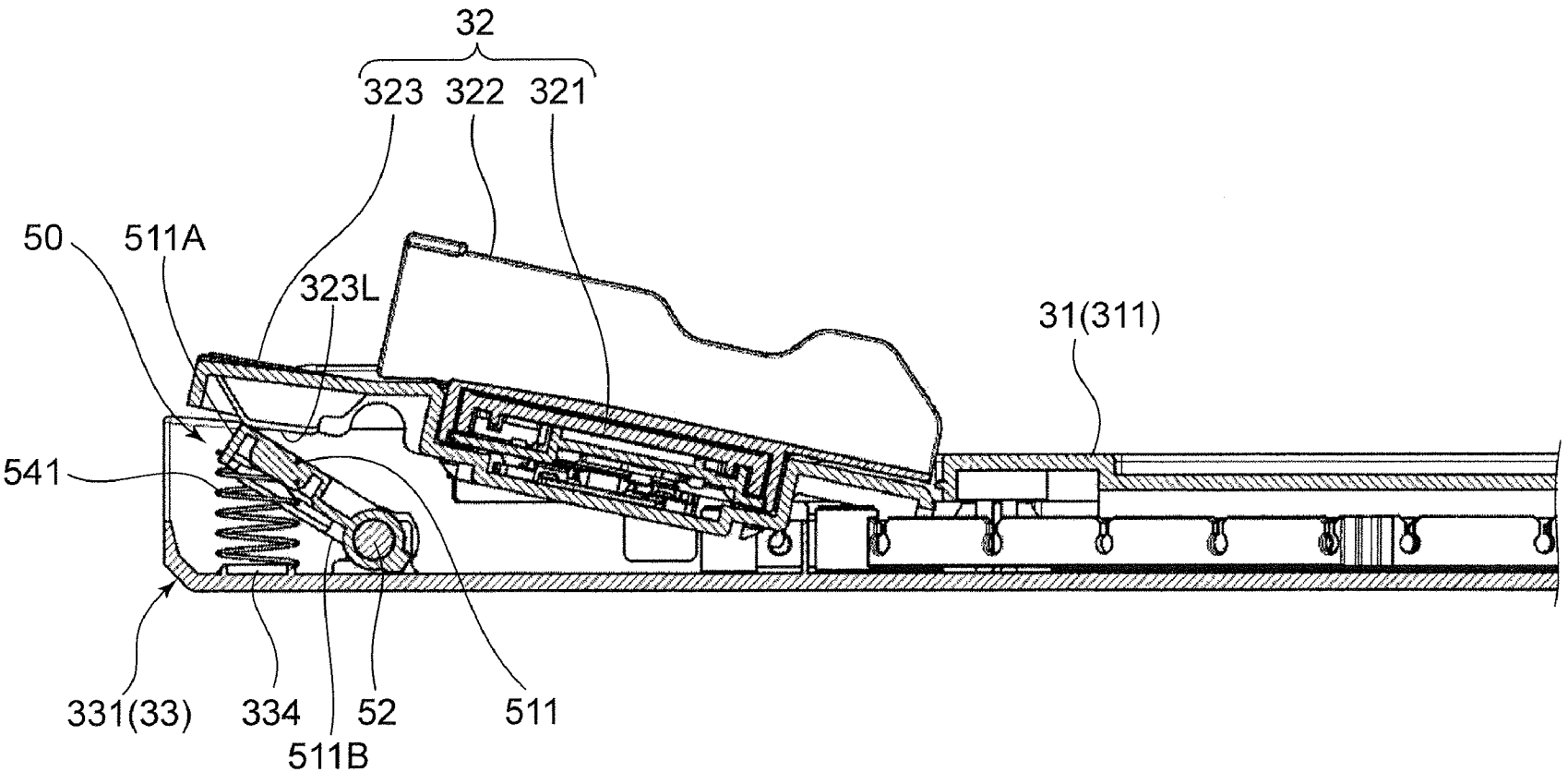
FIG. 8 is a sectional view along VIII-VIII of FIG. 7.
Figure 9:
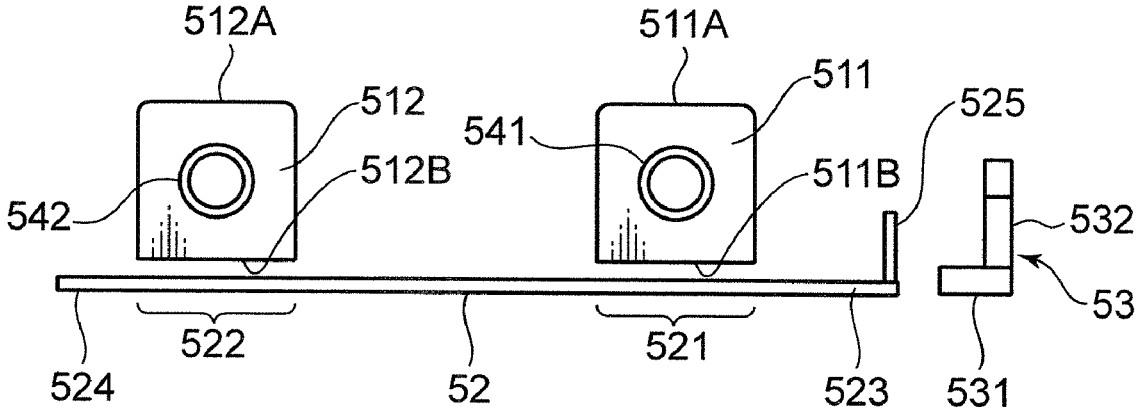
FIG. 9 is an exploded plan view of the lifting mechanism.
Figure 10:
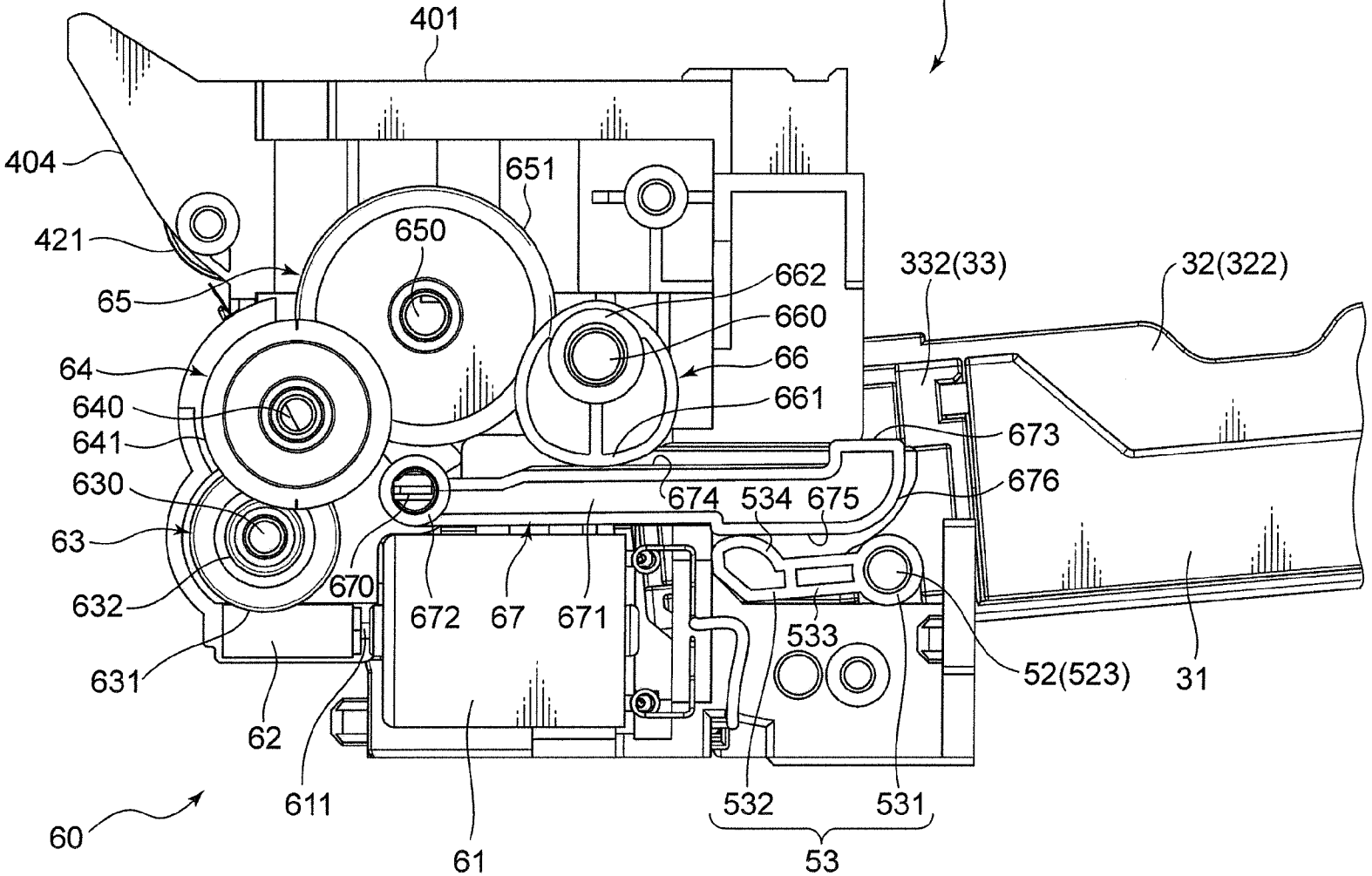
FIGS. 10 to 12 are side views showing an operation of the multi-tray unit.
Figure 11:
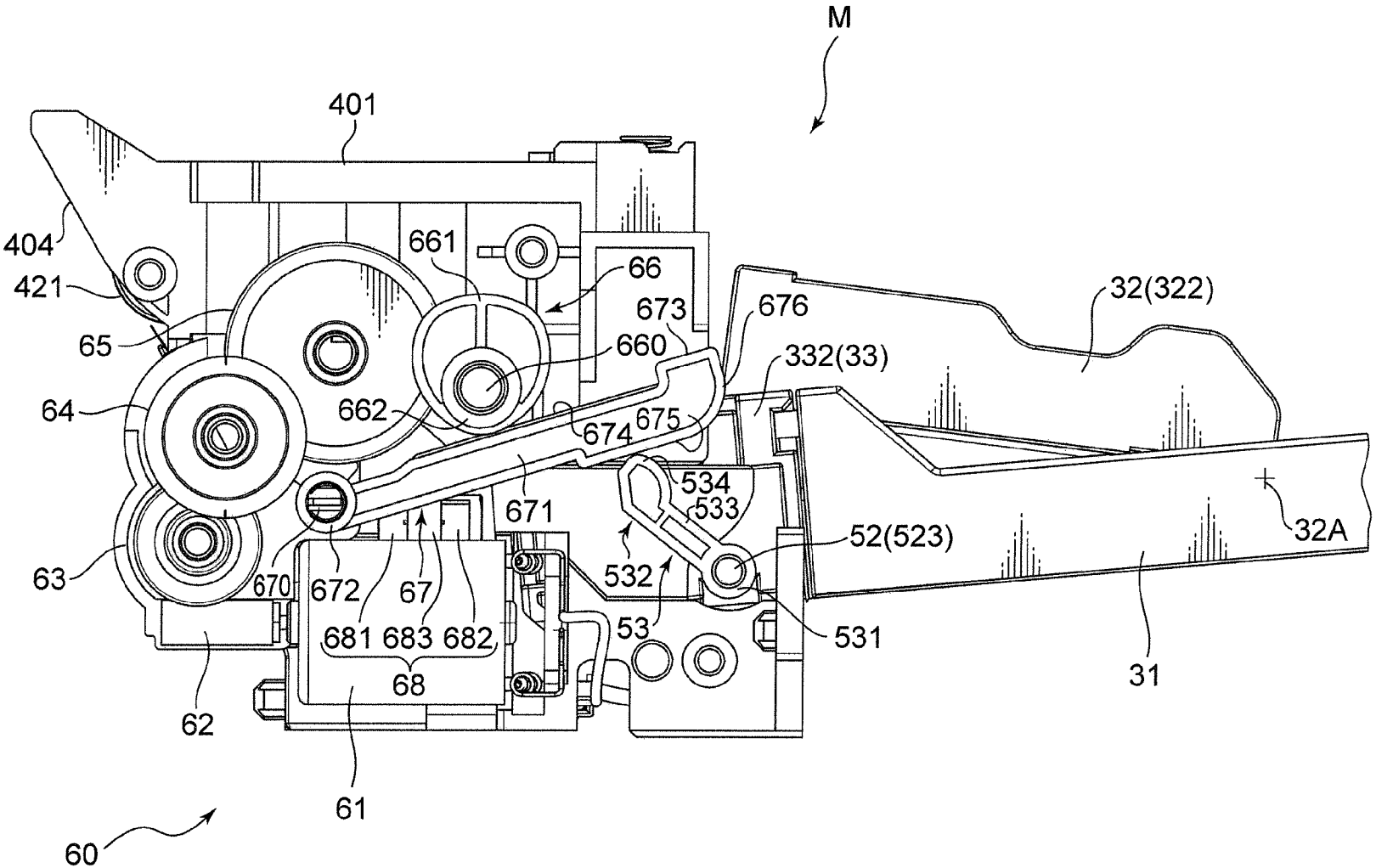
Figure 12:
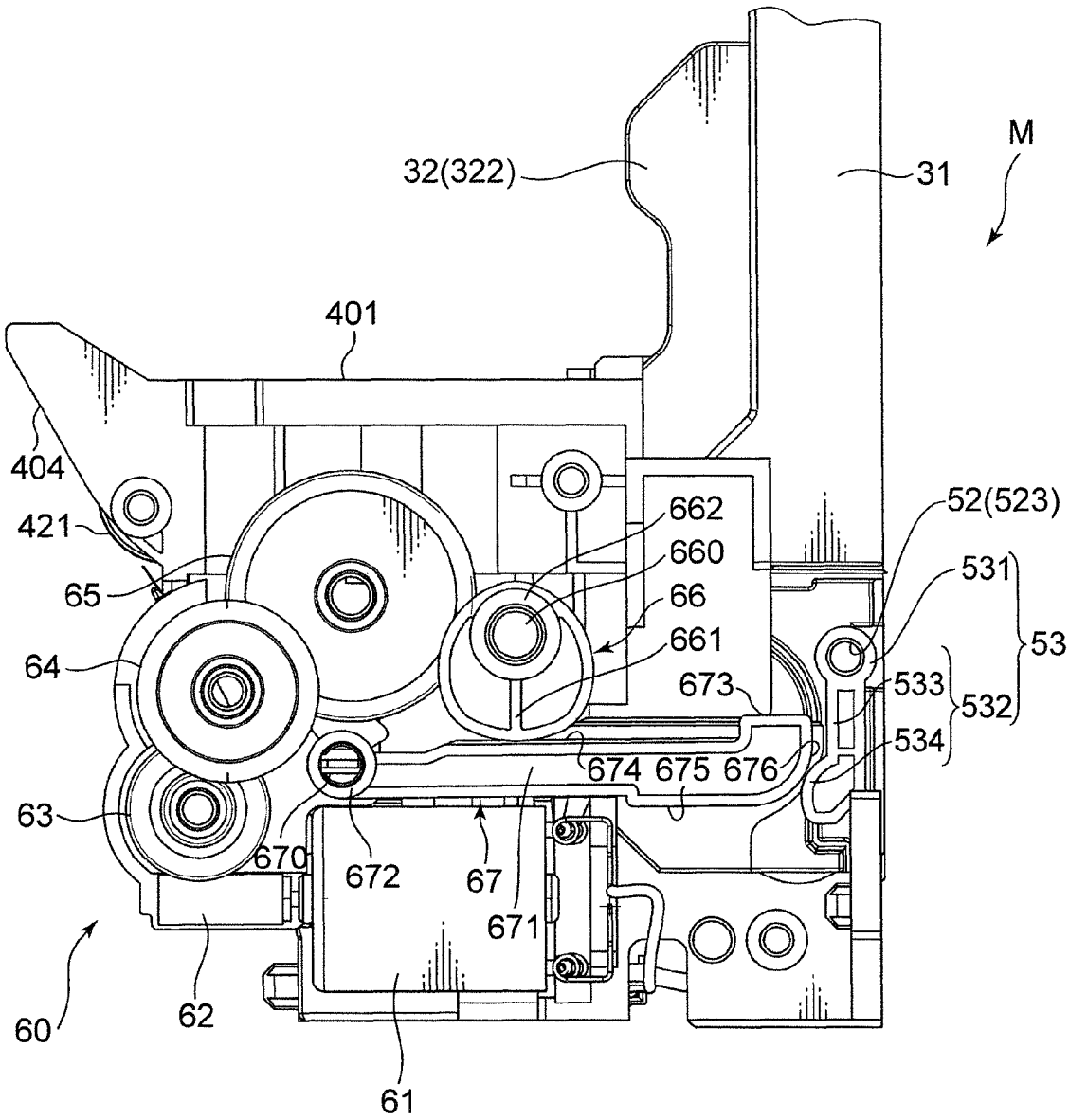

Next, the multi-tray unit M is described in detail with reference to FIGS. 3 to 12. FIG. 3 is a perspective view of the multi-tray unit M detached from the apparatus main body 2 shown in FIGS. 1 and 2. FIG. 4 is a perspective view of the multi-tray unit M with an upper cover 401 and a front cover 402 of the feeding unit 40 detached. FIG. 5 is a perspective view of the feed tray 30 in a lowered state of a lift plate 32. FIG. 6 is a perspective view of the feed tray 30 in a lifted state of the lift plate 32. FIG. 7 is a perspective view showing a state where a lifting mechanism 50 is assembled into the feed tray 30. FIG. 8 is a sectional view along VIII-VIII of FIG. 7. FIG. 9 is an exploded plan view of the lifting mechanism 50. FIGS. 10 to 12 are side views showing an operation of the multi-tray unit M.

The multi-tray unit M roughly includes the feed tray 30, the feeding unit 40, the lifting mechanism 50 (elevating member and biasing member) and a lowering mechanism 60. The feed tray 30 includes a tray main body 31 and the lift plate 32. The feeding unit 40 includes the feed roller 41 shown in FIG. 2. The lifting mechanism 50 is a mechanism capable of lifting the lift plate 32 by a biasing force to set the lift plate 32 to a feeding posture. The lowering mechanism 60 is a mechanism for generating a pressing force which acts against the biasing force of the lifting mechanism 50 and, as a result, lowering the lift plate 32 to a retracted posture. These respective parts are described below.

With reference to FIGS. 3 to 6, the tray main body 31 of the feed tray 30 is a part on which a sheet to be manually fed is to be placed and includes a main tray portion 311 which doubles as an outer cover of the apparatus main body 2 and an extendable tray portion 312 withdrawably mounted in the main tray portion 311. The main tray portion 311 is rotatably mounted on the lower housing 21 at a side of a base end portion 313 (feeding end side). Further, an end opening is formed in a leading end portion 314 of the main tray portion 311, and the extendable tray portion 312 is telescopically mounted in this end opening. Note that a surface opening 315 used to mount the lift plate 32 is formed at the side of the base end portion 313.

When not used, the feed tray 30 is in a closed posture with respect to the lower housing 21 and the extendable tray portion 312 is accommodated in the main tray portion 311 at this time. When a manual sheet feed is performed, the feed tray 30 is set to an opened posture with respect to the lower housing 21 and the extendable tray portion 312 is slidably pulled out from the main tray portion 31 according to a sheet size. To guide such a pull-out movement, a flat first elongated projection 316 is provided in the center of the main tray portion 311 in forward and backward directions and a second elongated projection 317 matching the lower surface of the first elongated projection 316 is provided in the center of the extendable tray portion 312 in forward and backward directions.

The lift plate 32 is a plate body with a substantially rectangular shape long in forward and backward directions, functions to lift up a sheet placed on the feed tray 30 so that the upper surface of the sheet comes into contact with the feed roller 41 (see FIG. 2) and the unillustrated pickup roller and includes a lift plate main body 321, a pair of cursors 322 and an introducing plate 323. The lift plate 32 is fitted into the surface opening 315 formed at the feeding end side of the tray main body 31, rotatably connected to the tray main body 31 at a first end portion 324 at an upstream side in a feeding direction, and displaceable between a feeding posture (see FIG. 6) where a second end portion 325 at a downstream side in the feeding direction is lifted up and a retracted posture (see FIG. 5) where the second end portion 325 is located lower than in the feeding posture due to its own weight.

The lift plate main body 321 includes a rotary shaft 32A supported on a front wall surface and a rear wall surface forming the surface opening 315 of the tray main body 31 as diagrammatically shown in FIGS. 5 and 6. The pair of cursors 322 are members which are adjusted according to the width of a sheet to be fed and slidably mounted on the lift plate main body 321 so as to be movable toward and away from each other in forward and backward directions. To realize these sliding movements, the lift plate 32 includes unillustrated pinion and rack. The introducing plate 323 is a plate-like member integrally connected to a downstream end of the lift plate main body 321 in the feeding direction, and arranged at a position facing the feed roller 41.

As shown in FIGS. 5 and 6, the tray main body 31 is mounted in a housing 33. The housing 33 includes a bottom plate 331 covering the bottom surface of the tray main body 31 and a front plate 332 and a rear plate 333 respectively standing up from the front and rear ends of this bottom plate 331, has a shallow U shape when viewed from left, and has such a width in forward and backward directions that the introducing plate 323 of the lift plate 32 can be received between the front plate 332 and the rear plate 333. Note that protrusions 334 used to mount first and second biasing springs 541, 542 to be described later project on the surface of the bottom plate 331 near the left end.

When being in the retracted posture shown in FIG. 5, the lift plate 32 is accommodated in the surface opening 315 and the tray main body 31 and the lift plate 32 become substantially horizontal. At this time, the introducing plate 323 is accommodated in the housing 33. On the other hand, when being in the feeding posture shown in FIG. 6, the lift plate 32 is rotated about the rotary shaft 32A to lift up the second end portion 325, whereby the introducing plate 323 projects upward from the housing 33.

The feeding unit 40 has a housing structure including the upper cover 401, the front cover 402, a right wall 403 and a left wall 404. The outer surface of the upper cover 401 functions as a guide surface for guiding a sheet reversed and conveyed in the reversing conveyance path 291 (see FIG. 2) and a plurality of ribs 401L extending in a direction, in which the sheet is conveyed to be reversed, project thereon. The outer surface of the left wall 404 also functions as a guide surface constituting a part of the sheet conveyance path 28.

With reference to FIG. 4, the feeding unit 40 includes a roller holder 411 for holding the feed roller 41 and the unillustrated pickup roller arranged upstream of the feed roller 41, a pivotal piece 412 for detecting that a sheet has been set on the feed tray 30, a first sensor 413 for detecting that the lift plate 32 has been lifted up to the feeding posture, and roller units 42 for conveying a sheet.

The roller holder 411 is so supported by the housing of the feeding unit 40 as to be pivotable about a rotary shaft of the feed roller 41. When the lift plate 32 is lifted up with a sheet set on the feed tray 30, the upper surface of the sheet is brought into contact with the circumferential surface of the pickup roller, and the pickup roller and the roller holder 411 holding this roller are lifted upward.

The pivotal piece 412 is pivotably suspended from the right wall 403. An optical sensor for receiving detection light is arranged on a pivot path of the pivotal piece 412. Whether or not a sheet is set is detected based on whether or not the detection light is interrupted by the pivotal piece 412 inclined when the sheet is placed on the feed tray 30.

The first sensor 413 includes a photointerrupter (PI) and the like and detects whether or not the roller holder 411 has been swung about the rotary shaft of the feed roller 41 by a set sheet and lifted up to a predetermined position by the lift plate 32 to ensure a predetermined feeding pressure. The first sensor 413 includes a light emitting element, a light receiving element arranged to face the light emitting element with a predetermined gap formed therebetween, and an interrupting piece disposed in the gap for interrupting light emitted from the light emitting element. This interrupting piece is mounted on the upper surface of the pivotal roller holder 411.

The roller unit 42 includes a freely rotatable roller 421 and a roller holder 422 for rotatably holding the roller 421. In this embodiment, four roller units 42 are arranged in a row. As shown in FIGS. 4 and 10, a part of the roller 421 projects from the left wall 404. The roller unit 42 is biased in a direction to project from the left wall 404 by a spring 423, and the roller 421 is pressed against a conveyor roller arranged in the apparatus main body 2 to face the roller 421.

Next, the lifting mechanism 50 is described with reference to FIGS. 7 to 9. The lifting mechanism 50 is a mechanism for lifting the lift plate 32 to the feeding posture and includes rectangular first and second lifting members 511, 512, a shaft member 52 having these first and second lifting members 511, 512 mounted thereon, a lever member 53 attached to a front end 523 of the shaft member 52, and the first and second biasing springs 541, 542 for respectively biasing the first and second lifting members 511, 512.

The first lifting member 511 includes a free end 511A held in contact with a rib 323L (see FIG. 8) projecting on the rear surface of the lift plate 32 and a base end portion 511B formed with an insertion hole, through which the shaft member 52 is inserted. Similarly, the second lifting member 512 includes a free end 512A held in contact with the rib 323L on the rear surface of the lift plate 32 and a base end portion 512B formed with an insertion hole, through which the shaft member 52 is inserted. First and second mounting portions 521, 522 are set on the shaft member 52 while being spaced apart in a longitudinal direction of the shaft member 52. The base end portion 511B of the first lifting member 511 and the base end portion 512B of the second lifting member 512 are respectively fixed by having the first and second mounting portions 521, 522 inserted therein.

The front end 523 of the shaft member 52 is supported rotatably about an axis of the shaft member 52 by the front plate 332 of the housing 33, and a rear end 524 is likewise supported rotatably about the axis of the shaft member 52 by a bearing portion (not shown) provided on the rear plate 332 of the housing 33. A pin 525 projecting radially outwardly of the shaft member 52 is attached to the front end 523 of the shaft member 52.

The lever member 53 includes a tubular portion 531 and a lever main portion 532 integral to the tubular portion 531. The tubular portion 531 is a part to be attached to the front end 523 of the shaft member 52, and a slit for allowing the passage of the pin 525 is formed in a longitudinal direction. The lever main portion 532 is provided with a receiving portion into which the pin 525 is fittable. With the lever member 53 properly attached to the shaft member 52, the pin 525 is accommodated in the receiving portion, whereby the lever member 53 and the first and second lifting members 511, 512 also rotate when the shaft member 52 rotates about its axis. In other words, when the lever member 53 rotates about an axis of the tubular portion 531, the first and second lifting members 511, 512 integrally rotate in the same direction.

The first and second biasing springs 541, 542 are coil springs and respectively give upward lifting biasing forces to the first and second lifting members 511, 512. The bottom ends of the first and second biasing springs 541, 542 are fitted to the protrusions 334 (see FIGS. 6 and 8) and the upper ends thereof are fitted into the rear surfaces of the first and second lifting members 511, 512.

Since the free ends 511A, 512A of the first and second lifting members 511, 512 are in contact with the rear surface of the lift plate 32, the lift plate 32 is lifted (feeding posture) by the biasing forces of the first and second biasing springs 541, 542 as shown in FIGS. 7 and 8 in a state where a pressing force is not particularly given to the lever member 53. On the other hand, if a pressing force which rotates the lever member 53 counterclockwise about the axis of the tubular portion 531 and is larger than the biasing forces of the first and second biasing springs 541, 542 (pressing force which acts against the biasing force) is given to the lever member 53 in the state of FIG. 7, the first and second members 511, 512 are inclined to become substantially horizontal. As a result, the lift plate 32 loses support of the first and second lifting members 511, 512 and rotates about the axis of the rotary shaft 32A due to its own weight to be lowered to a state where it is substantially horizontal (retracted posture).

Next, the lowering mechanism 60 is described in detail mainly with reference to FIG. 4 and FIGS. 10 to 12. The lowering mechanism 60 is a mechanism for giving a pressing force against the biasing forces of the first and second biasing springs 541, 542 to the lever member 53 when appropriate and, as a result, lowering the lift plate 32. The lowering mechanism 60 includes a motor 61 (driving device), a worm 62, a worm wheel 63, a first reduction gear 64, a second reduction gear 65, an eccentric cam 66 (posture changing member/cam member), an arm member 67 and a second sensor 68 (shown only in FIG. 11).

The motor 61 is a DC motor or the like that can be driven in forward and reverse directions and generates a drive force for driving and rotating the eccentric cam 66. As shown in FIG. 10, the worm 62 is fixed to an output shaft 611 of the motor 61 and rotates when the motor 61 operates. The operation of the motor 61 is controlled by a controller 612 (shown only in FIG. 4). The controller 612 controls the rotation of the motor 61 and the stop of this rotation based on outputs of the above first sensor 413 and second sensor 68.

With reference to FIG. 10, the worm wheel 63 freely rotates about an axis of a first shaft 630 and includes a bevel gear portion 631 engaged with the worm 62 and a gear portion 632 having a smaller outer diameter than the bevel gear portion 631. The first reduction gear 64 freely rotates about an axis of a second shaft 640 and includes a large diameter portion 641 engaged with the gear portion 632 of the worm wheel 63 and a small diameter portion (not shown) having a smaller outer diameter than the large diameter portion 641. The second reduction gear 65 freely rotates about an axis of a third shaft 650 and includes a gear portion 651 engaged with the small diameter portion of the first reduction gear 64 and a rotation gear (not shown) fixed to a rotary shaft 660 of the eccentric cam 66.

The eccentric cam 66 is a cam member which rotates by having a rotational force about an axis of the rotary shaft 660 given from the rotary shaft 660 and includes a large diameter portion 661 and a small diameter portion 662. When the motor 61 is operated and a rotational force is generated at the output shaft 611, this rotational force is transmitted to the worm 62 and the worm wheel 63 and input to the rotation gear fixed to the rotary shaft 660 after being decelerated to a predetermined speed by the first and second reduction gears 64, 65. In this way, the eccentric cam 66 rotates about the axis of the rotary shaft 660.

An arm member 67 is a member, one end of which is mounted on a rotary shaft 670 and the other end of which is a free end, and includes an arm main body 671, a tubular portion 672, a curved leading end portion 673, a first contact portion 674, a second contact portion 675 and an extended portion 676. The arm main body 671 is a thin and long bar-shaped member, has the tubular portion 672 provided on one end thereof and the curved leading end portion 673 provided at the other end thereof and has the first contact portion 674 formed on the upper side thereof in FIG. 10 and the second contact portion 675 and the extended portion 676 formed on the lower side thereof.

The tubular portion 672 is rotatably fitted on the rotary shaft 670, whereby the arm member 67 is rotatable about the axis of the rotary shaft 670. The biasing forces of the first and second biasing springs 541, 542 are given to the arm member 67 via the lever member 53. These biasing forces act in a direction to constantly lift up the curved leading end portion 673, i.e. to constantly press the arm member 67 against the eccentric cam 66 with the rotary shaft 670 as a supporting point of rotation.

The first contact portion 674 is a flat contact surface, with which the circumferential surface of the eccentric cam 66 comes into contact (interferes). The first contact portion 674 is pressed against the circumferential surface of the eccentric cam 66 by the biasing forces of the above first and second biasing springs 541, 542. Accordingly, the posture of the arm member 67 is changed depending on whether or not the circumferential surface of the large or smaller diameter portion 661 or 662 of the eccentric cam 66 interferes with the first contact portion 674. In FIG. 10, the arm member 67 is in a horizontal posture since the large diameter portion 661 of the eccentric cam 66 and the first contact portion 674 are in contact. On the other hand, since the small diameter portion 662 of the eccentric cam 66 and the first contact portion 674 are in contact in FIG. 11, the arm member 67 rotates counterclockwise about the axis of the rotary shaft 670 to lift up the curved leading end portion 673.

The second contact portion 675 is a flat contact surface with which the lever member 53 of the lifting mechanism 50 comes into contact when the lift plate 32 changes its posture between the feeding posture and the retracted posture (FIGS. 10 and 11) in a state where the feed tray 30 (tray main body 31) is opened with respect to the apparatus main body 2. The lever main portion 532 of the lever member 53 includes a bar-shaped portion 533 having a base end portion thereof connected to the tubular portion 531, and a leading end portion 534 including an arcuate contact surface connected to a leading end portion of the bar-shaped portion 533. Since the lever member 53 is biased in a clockwise direction about the axis of the tubular portion 531 by the above first and second biasing springs 541, 542, the leading end portion 534 is constantly pressed against the second contact portion 675.

The extended portion 676 is a curved contact surface with which the lever member 53 comes into contact in a state where the feed tray 30 is closed with respect to the apparatus main body 2 (FIG. 12). The extended portion 676 is a curved surface extending from one end of the second contact portion 675 to the curved leading end portion 673 and curved at about 90°. The lever member 53 receives a pressing force from this curved leading end portion 673 in the opened state of the feed tray 30 with respect to the apparatus main body 2, during transition from the opened state to the closed state and in the closed state.

The second sensor 68 includes a light emitting element 681 for emitting detection light, a light receiving element 682 arranged to face the light emitting element 681 for receiving the detection light and a detection gap 683 provided between the light emitting element 681 and the light receiving element 682. The unillustrated interrupting piece projecting from the arm member 67 can pass the detection gap 683. The detection light is interrupted by the interrupting piece when the arm member 67 is in a horizontal posture (FIG. 10) and the interrupting plate moves out of the detection gap 683 and the detection light is not interrupted when the arm 67 rotates upward to an inclined posture (FIG. 11).

The controller 612 for the motor 61 determines that the lift plate 32 is in the predetermined retracted posture upon detecting that the detection light has been interrupted based on an output signal of the second sensor 68. Further, the controller 612 determines that the lift plate 32 is in the feeding posture upon detecting that the roller holder 411 has been lifted up to a predetermined height via the lift plate 32 based on an output signal of the first sensor 413. In this way, the controller 612 drives and rotates the motor 61 while detecting a movement upper limit or a movement lower limit of the lift plate 32 based on the output signal of the first sensor 413 or the second sensor 68 when the posture of the lift plate 32 is changed between the retracted posture and the feeding posture.

Next, the operation of the lowering mechanism 60 constructed as described above is described. FIG. 10 shows a state where the lift plate 32 is in the retracted posture when the feed tray 30 (tray main body 31) is in the opened posture with respect to the apparatus main body 2. In the retracted posture, the large diameter portion 661 of the eccentric cam 66 and the first contact portion 674 of the arm member 67 are in contact. When the posture is changed from the feeding posture to the retracted posture, the arm member 67 rotates clockwise about the axis of the rotary shaft 670 to a substantially horizontal posture (first posture).

When the arm member 67 is in the horizontal posture, a pressing force is given to the leading end portion 534 of the lever member 53 by the second contact portion 675 of the arm member 67. This pressing force acts against the biasing forces given to the lever member 53 by the first and second biasing springs 541, 542. Thus, the lever member 53 rotates counterclockwise about the axis of the tubular portion 531 thereof and, accordingly, the shaft member 52 also rotates counterclockwise. Therefore, the first and second lifting members 511, 512 (FIGS. 7 and 8) integrally mounted on the shaft member 52 also rotate counterclockwise, with the result that the lift plate 32 loses lift supporting points and rotates about the axis of the rotary shaft 32A due to its own weight to be lowered to the substantially horizontal posture (retracted posture).

FIG. 11 shows a state where the lift plate 32 is in the feeding posture when the feed tray 30 (tray main body 31) is in the opened state with respect to the apparatus main body 2. In the feeding posture, the small diameter portion 662 of the eccentric cam 66 and the first contact portion 674 of the arm member 67 are in contact. At this time, the pressing force given from the second contact portion 675 of the arm member 67 to the leading end portion 534 of the lever member 53 is released. Thus, the leading end portion 534 of the lever member 53 conversely presses the second contact portion 675 of the arm member 67 by the biasing forces of the first and second biasing springs 541, 542.

As a result, when the posture is changed from the retracted posture to the feeding posture, the arm member 67 rotates counterclockwise about the axis of the rotary shaft 670 to an inclined posture (second posture) where the curved leading end portion 673 is lifted upward. Further, the lever member 53 rotates clockwise to an inclined posture where the leading end portion 534 is lifted upward. Such rotation of the lever member 53 is transmitted to the first and second lifting members 511, 512 via the shaft member 52 and rotates them clockwise. Then, the lift plate 32 rotates clockwise about the axis of the rotary shaft 32A to the lifted up state (feeding posture).

FIG. 12 shows the closed state of the feed tray 30 (tray main body 31) with respect to the apparatus main body 2. In the process of closing the tray main body 31 from the state shown in FIG. 10 to the state shown in FIG. 12, the leading end portion 534 of the lever member 53 slides on surfaces of the second contact portion 675 and the extended portion 676 of the arm member 67. The extended portion 676 is shaped in conformity with a movement path along which the leading end portion 534 of the lever member 53 constantly receives a pressing force.

In other words, the pressing force is constantly given from the arm member 67 to the lever member 53 to prevent the lift plate 32 from being lifted up in the opened state of the tray main body 31, during the transition from the opened state to the closed state and after the transition to the closed state. By employing such a construction, the tray main body 31 can be smoothly opened and closed with respect to the apparatus main body 2. Further, loads of the first and second biasing springs 541, 542 can be reduced when the tray main body 31 is closed and the transmission of the biasing force of the lift plate 32 to peripheral devices can be suppressed.

According to the multi-tray unit M of this embodiment described above, the lift plate 32 is lifted to the feeding posture by the first and second lifting members 511, 512 supported by the biasing forces of the first and second biasing springs 541, 542, whereas the lift plate 32 is changed to the retracted posture by giving a pressing force larger than the biasing forces from the arm member 67 to the lever member 53. Thus, the posture of the lift plate 32 can be stably controlled and a good sheet feeding performance can be ensured. If a large external force acts on the lift plate 32 with the lift plate 32 set in the feeding posture, the lift plate 32 can be lowered and this external force is absorbed by the first and second biasing springs 541, 542. Therefore, there is no likelihood of mechanical damage.

The embodiment of the present invention is described above. The present invention is not limited to this and may be, for example, embodied as follows.

(1) In the above embodiment, the multi-tray unit M applied to the image forming apparatus 1 is illustrated as an example of the sheet feeder. Without being limited to the image forming apparatus 1, the sheet feeder of the present invention is applicable to various sheet processing apparatuses.

Figure 13:
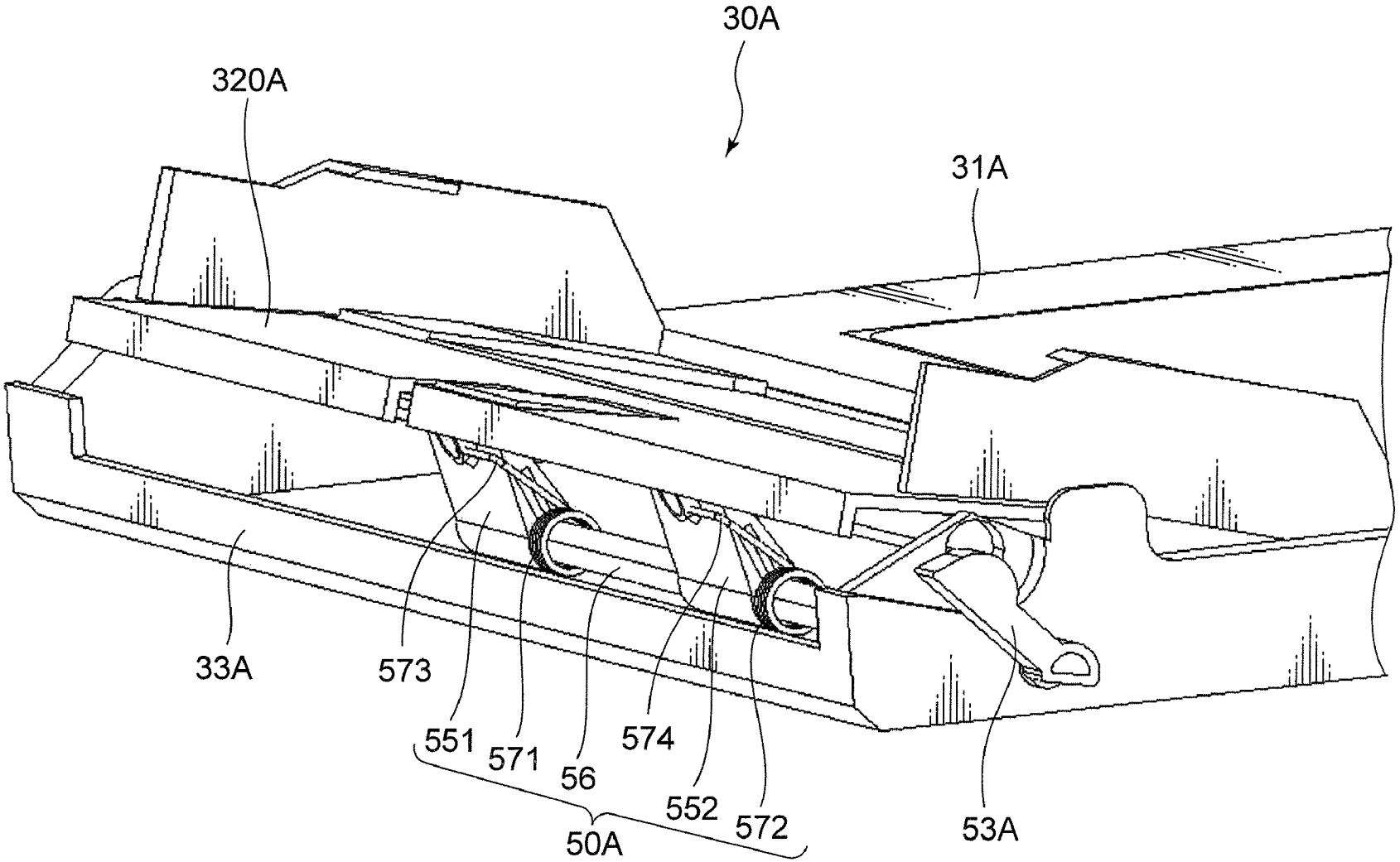
FIG. 13 is a perspective view showing a first modification of the lifting mechanism.

(2) In the above embodiment, the first and second biasing springs 541, 542 made of coil springs are illustrated as an example of a biasing member. Instead of the coil springs, various biasing members may be employed. FIG. 13 is a perspective view showing a feed tray 30A employing a lifting mechanism 50A according to a first modification. The feed tray 30A includes a tray main body 31A, a lift plate 320A and a housing 33A. The lifting mechanism 50A includes first and second lifting members 551, 552, a shaft member 56 having these first and second lifting members 551, 552 mounted thereon, and a lever member 53A attached to one end of the shaft member 56. These constructions are similar to those of the first embodiment.

However, the lifting mechanism 50A of the first modification differs from the above embodiment in that first and second torsion coil springs 571, 572 are employed as biasing members. The first and second torsion coil springs 571, 572 commonly have the shaft member 56 inserted through coiled parts thereof. One end of the first torsion coil spring 571 is attached to the rear surface of the first lifting member 551 and the other end is mounted at a specified position of the housing 33A. Similarly, one end of the second torsion coil spring 572 is attached to the rear surface of the second lifting member 552 and the other end is mounted at a specified position of the housing 33A. The first and second lifting members 551, 552 are biased in a direction to lift the lift plate 320A by biasing forces of these first and second torsion coil springs 571, 572. Similarly, the lever member 53A is also biased. An operation similar to that of the above embodiment can be performed also by these first and second torsion coil springs 571, 572.

Figure 14:
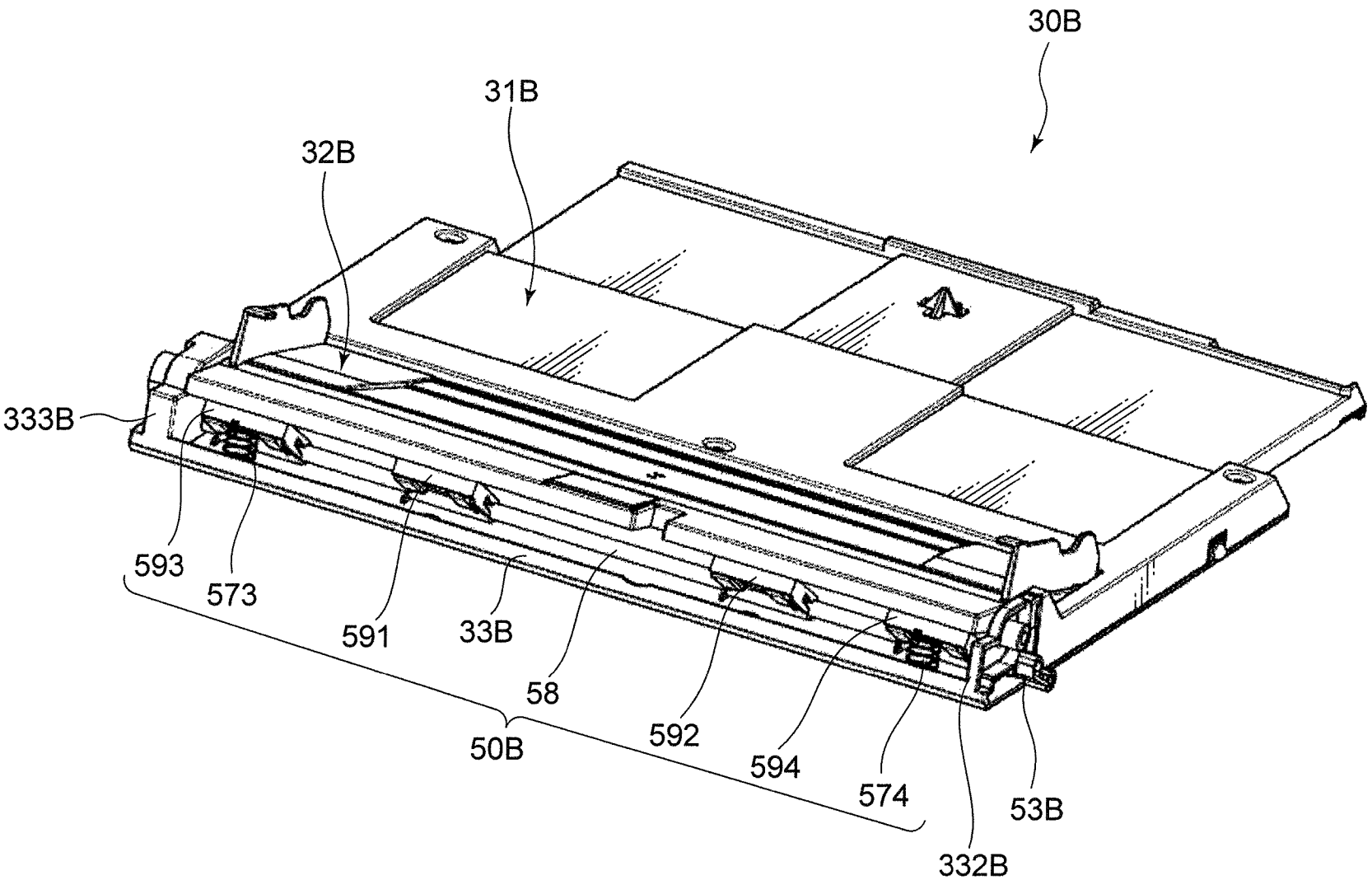
FIG. 14 is a perspective view showing a second modification of the lifting mechanism.

(3) Although the lifting members are directly biased by the biasing members in the above embodiment, they may be indirectly biased. FIG. 14 is a perspective view showing a feed tray 30B employing a lifting mechanism 50B according to a second modification. The feed tray 30B includes a tray main body 31B, a lift plate 32B and a housing 33B. The lifting mechanism 50B includes first and second lifting members 591, 592, first and second pressure receiving members 593, 594, a shaft member 58 having these lifting members 591, 592 and pressure receiving members 593, 594 mounted thereon, and a lever member 53B attached to one end of the shaft member 58.

Leading end portions of the first and second lifting members 591, 592 mounted near the center of the shaft member 58 are in contact with the rear surface of the lift plate 32B and lift the lift plate 32B upward. On the other hand, the first and second pressure receiving members 593, 594 are mounted near the opposite ends of the shaft member 58 at such an angle to be more horizontal than the first and second lifting members 591, 592. Thus, the first and second pressure receiving members 593, 594 are not normally in contact with the rear surface of the lift plate 32B. Further, first and second biasing springs 573, 574 made of coil springs are provided on the rear surfaces of the first and second pressure receiving members 593, 594 to bias the first and second pressure receiving members 593, 594. The opposite ends of the shaft member 58 are supported on a front plate 332B and a rear plate 333B.

According to the lifting mechanism 50B of the second embodiment, the first and second pressure receiving members 593, 594 mounted on the opposite end portions of the shaft member 58 are biased upward by the first and second biasing springs 573, 574 and these biasing forces are transmitted to the first and second lifting members 591, 592 mounted near the center of the shaft member 58 via the shaft member 58, thereby lifting the lift plate 32. According to such a construction, a central part of the lift plate 32B can be prevented from bulging since the biasing forces are not directly given to the first and second lifting members 591, 592 from the first and second biasing springs 573, 574. Further, if a heavy bundle of sheets is placed on the feed tray 30B to warp the lift plate 32B, the opposite end portions of the lift plate 32B can be supported by the first and second pressure receiving members 593, 594.

According to the sheet feeder and the image forming apparatus of the present invention described above, the elevating member comes into contact with the lift plate to lift the lift plate to the feeding posture and a pressing force is given from the lowering mechanism to the elevating member to change the posture of the lift plate to the retracted posture. Thus, the posture of the lift plate can be stably controlled and a good sheet feeding performance can be ensured. On the other hand, since the elevating member lifts the lift plate to the feeding posture by a biasing force given from the biasing member, a large external force can be absorbed by the biasing member if such a force acts on the lift plate. Therefore, it is possible to provide a sheet feeder and an image forming apparatus which are convenient for users and has less breakdowns and whose cost can be reduced.

This application is based on Japanese Patent application No. 2010-062496 filed in Japan Patent Office on Mar. 18, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeder, comprising:

a tray main body on which a sheet to be fed is to be placed;

a lift plate body arranged at a feeding end side of the tray main body, rotatably connected to the tray main body at a first end edge portion at an upstream side in a feeding direction and displaceable between a feeding posture where a second end edge portion at a downstream side in the feeding direction is lifted up and a retracted posture where the second end edge portion is located lower than in the feeding posture due to its own weight;

an elevating member including a lifting member that comes into contact with the lift plate, a shaft for rotating the lifting member so that the lift plate is set to the feeding posture and the retracted posture while being held in contact with the lifting member, and a lever that integrally rotates with the shaft;

a biasing member for giving a biasing force to the elevating member in such a direction that the elevating member lifts the lift plate to the feeding posture; and a lowering mechanism including an arm that comes into contact with the lever, a cam that interferes with the arm to change the posture of the arm between a first posture where a pressing force, which acts against the biasing force of the biasing member, is given to the lever to lower the lift plate to the retracted posture, and a second posture where the pressing force is released and the cam receives the biasing force from the lever, and a motor for driving the cam.

2. A sheet feeder according to claim 1, wherein:

a plurality of lifting members are mounted at predetermined intervals in a longitudinal direction of the shaft.

3. A sheet feeder according to claim 1, further comprising a housing to which the tray main body is openably and closably attached to receive the supply of a sheet, wherein:

the arm can be set to the first and second postures by the cam with the tray main body opened with respect to the housing, and the arm includes an extended portion for constantly giving a pressing force to the lever with the tray main body closed with respect to the housing.

4. A sheet feeder according to claim 3, wherein:

the arm is a thin and long bar-shaped member, one end of which is mounted on a rotary shaft and the other end of which is a free end, and includes a first contact portion which comes into contact with the cam, a second contact portion which comes into contact with the lever and a curved surface as the extended portion provided at a side of the free end.

5. An image forming apparatus, comprising:

an image forming station for performing an image forming process on a sheet;

a housing for housing the image forming station; and a sheet feeder mounted in the housing for feeding a sheet to the image forming station;

wherein the sheet feeder includes:

a tray main body on which a sheet to be fed is to be placed;

a lift plate arranged at a feeding end side of the tray main body, rotatably connected to the tray main body at a first end edge portion at an upstream side in a feeding direction and displaceable between a feeding posture where a second end edge portion at a downstream side in the feeding direction is lifted up and a retracted posture where the second end edge portion is located lower than in the feeding posture due to its own weight;

an elevating member including a lifting member that comes into contact with the lift plate, a shaft for rotating the lifting member so that the lift plate is set to the feeding posture and the retracted posture while being held in contact with the lifting member, and a lever that integrally rotates with the shaft;

a biasing member for giving a biasing force to the elevating member in such a direction that the elevating member lifts the lift plate to the feeding posture; and a lowering mechanism including an arm that comes into contact with the lever, a cam that interferes with the arm to change the posture of the arm between a first posture where a pressing force, which acts against the biasing force of the biasing member, is given to the lever to lower the lift plate to the retracted posture and a second posture where the pressing force is released and the cam receives the biasing force from the lever, and a motor for driving the cam.

6. An image forming apparatus according to claim 5, wherein:

a plurality of lifting members are mounted at predetermined intervals in a longitudinal direction of the shaft.

7. An image forming apparatus according to claim 5, wherein:

the arm can be set to the first and second postures by the cam with the tray main body opened with respect to the housing, and the arm includes an extended portion for constantly giving a pressing force to the lever with the tray main body closed with respect to the housing.

8. An image forming apparatus according to claim 7, wherein:

the arm is a thin and long bar-shaped member, one end of which is mounted on a rotary shaft and the other end of which is a free end, and includes a first contact portion which comes into contact with the cam, a second contact portion which comes into contact with the lever and a curved surface as the extended portion provided at a side of the free end.

9. A sheet feeder, comprising:

a tray main body on which a sheet to be fed is to be placed;

a housing to which the tray main body is openably and closably attached to receive a supply of the sheet a lift plate arranged at a feeding end side of the tray main body, rotatably connected to the tray main body at a first end edge portion at an upstream side in a feeding direction and displaceable between a feeding posture where a second end edge portion at a downstream side in the feeding direction is lifted up and a retracted posture where the second end edge portion is located lower than in the feeding posture due to its own weight;

an elevating member including a lifting member that comes into contact with the lift plate, a shaft for rotating the lifting member so that the lift plate is set to the feeding posture and the retracted posture while being held in contact with the lifting member, and a lever that integrally rotates with the shaft;

a biasing member for giving a biasing force to the elevating member in such a direction that the elevating member lifts the lift plate to the feeding posture; and a lowering mechanism including an arm that comes into contact with the lever, a posture changing member that interferes with the arm to change the posture of the arm between a first posture where a pressing force, which acts against the biasing force of the biasing member, is given to the lever to lower the lift plate to the retracted posture, and a second posture where the pressing force is released and the posture changing member receives the biasing force from the lever, and a driving device for driving the posture changing member, wherein:

the arm can be set to the first and second postures by the posture changing member with the tray main body opened with respect to the housing, and the arm includes an extended portion for constantly giving a pressing force to the lever with the tray main body closed with respect to the housing.

10. A sheet feeder according to claim 9, wherein:

the arm is a thin and long bar-shaped member, one end of which is mounted on a rotary shaft and the other end of which is a free end, and includes a first contact portion that comes into contact with the posture changing member, a second contact portion that comes into contact with the lever and a curved surface as the extended portion provided at a side of the free end.

* * * * *